US005366185A

United States Patent [19]

Michael et al.

[11] Patent Number: 5,366,185

[45] Date of Patent: Nov. 22, 1994

[54] CONTROL BOARD MOUNTING MEANS AND METHOD

[75] Inventors: Daryl A. Michael, Newton; Herbert E. Scott, Kellogg, both of Iowa

[73] Assignee: Maytag Corporation, Newton, Iowa

[21] Appl. No.: 114,680

[22] Filed: Aug. 31, 1993

[51] Int. Cl.[5] ..... G12B 9/00

[52] U.S. Cl. ..... 248/27.1; 361/725

[58] Field of Search ..... 248/27.1, 27.3; 361/801, 725, 727, 726, 732, 645

[56] References Cited

U.S. PATENT DOCUMENTS

| | | | |
|---|---|---|---|
| 2,296,369 | 9/1942 | Richmond | 173/338 |
| 2,566,064 | 8/1951 | Keim | 361/726 |
| 2,994,807 | 8/1961 | Devine | 361/727 |
| 3,052,365 | 9/1962 | Pappano | 339/126 |
| 3,382,416 | 5/1968 | Jacobs | 361/645 |
| 3,631,299 | 12/1971 | Meyer | 317/120 |
| 3,763,400 | 10/1973 | Layton | 361/725 X |
| 3,895,268 | 7/1975 | May | 248/27.1 X |
| 4,019,099 | 4/1977 | Calabro | 361/399 |
| 4,056,699 | 11/1977 | Jordan | 200/5 A |
| 4,092,698 | 5/1978 | Brefka | 361/399 |
| 4,149,217 | 4/1979 | Tucker | 361/358 |
| 4,336,569 | 6/1982 | Rsuda | 361/395 |
| 4,558,398 | 12/1985 | Drake | 361/732 X |
| 4,648,737 | 3/1987 | Lake | 361/732 |
| 4,731,703 | 3/1988 | Tsukaguchi | 361/727 |
| 4,765,697 | 8/1988 | Gardell | 312/229 |
| 4,858,070 | 8/1989 | Buron | 361/725 X |
| 4,976,358 | 12/1990 | Stickel | 361/801 X |
| 5,229,923 | 7/1993 | Long | 361/801 |

*Primary Examiner*—J. Franklin Foss

*Attorney, Agent, or Firm*—Zarley, McKee, Thomte, Voorhees & Sease

[57] ABSTRACT

A control board assembly including a control panel and a carrier plate which have alternatively occurring tab and hook members. The tab and hook members of the two elements can be overlappingly engaged to prevent movement of the carrier plate with respect to the control panel. The carrier plate is further comprised of a face plate which is adapted to receive one or more circuit boards held in parallel orientation by rails. When the carrier plate is slidably moved to an engaged position with the control panel, the carrier plate can be locked against further movement by an integral catch or by attaching one screw which extends through the carrier plate and threadably engages a bore located on the control panel.

27 Claims, 5 Drawing Sheets

CONTROL BOARD MOUNTING MEANS AND METHOD

BACKGROUND OF THE INVENTION

This invention relates to a control board mounting means and a method of mounting the control board in an appliance, such as a dishwasher.

In recent years, appliance controls have expanded from mechanical dials and switches to include electronic controls. A typical electronic dishwasher control includes a cycle selection panel located on the access door. The electronic circuitry may include a terminal board, a relay board, and a main control board, each of which is separately mounted on a carrier plate with a plurality of screws attaching it to the dishwasher control panel. The individual mounting of these components increases manufacturing time and costs. Also, the components are not well protected and subject to damage during shipping. The electronic control board associated with the cycle selection panel contains a touch pad area having buttons or keys located thereon for activating the circuitry for different washing operations and options.

In order to improve the efficiency and quickness with which the electronic circuits may be mounted to the control panel, it is desirable to minimize the number of fasteners utilized in the assembly process while maintaining support throughout for desirable feel when activating the circuitry. It is also desirable to minimize the number of components and assembly steps, and to provide a control board which is easy and safe to transport.

SUMMARY OF THE INVENTION

A primary object of the present invention is the provision of an improved method and means for mounting a circuit board carrier plate on a control panel.

A further object of the present invention is the provision of an improved method and means for control panel and carrier plate assembly.

A further object of the present invention is the provision of an improved method and means for control panel and carrier plate assembly which permits the control panel and carrier plate to be assembled with a minimum number of steps and components.

A further object of the present invention is the provision of an improved method and means for control panel and carrier plate assembly which provides tabs and hooks on the carrier plate and control panel which are adapted to matingly and reciprocally fit each other.

A further object of the present invention is to minimize the possibility of misassembly, improper assembly or incomplete assembly.

A further object of the present invention is the provision of an improved method and means for control panel and carrier plate assembly which holds the carrier plate in position until replacement or further assembly is required.

A further object of the present invention is the provision of a method and means for control panel and carrier plate assembly which is economical, efficient in use, and which results in a durable assembly which can be safely transported without damage.

The present invention utilizes a cycle and option selection panel having a control panel and a carrier plate. The cycle selection panel is mounted on the access door or other control mounting area such as a backsplash for a dishwasher or other appliance.

When part of a dishwasher access door, the cycle selection panel is positioned near the top portion of the hinged dishwasher door and contains buttons, touchpads or other selection means thereon for selecting multiple washing operations and options. The cycle selection panel contains a control panel in which a carrier plate is mounted. The carrier plate contains the circuitry and selection means with which a user selects the multiple washing operations and options.

The present invention utilizes a locate-and-lock type of coupling means wherein a plurality of hook members and tab members spaced along the periphery of the carrier plate engage similar structures located on the periphery of an opening in the control panel. The carrier plate is then moved relative to the control panel into a locked position so the tab members of the carrier plate are locked with the hook members of the control panel and the tabs of the control panel are locked with the hooks of the carrier plate. With this assembly and coupling completed, a single screw or other locking means can be used to secure this engaged position between the carrier plate and the control panel.

In operation, the carrier plate is initially located in an opening of the control panel in such a manner that the hooks and tabs of the carrier plate and the control panel are not engaged. In this position, the carrier plate is free to be lifted out of the opening in the control panel without operating any locking means or attachment devices. However, by slidably moving the carrier plate into an engaging position such that the hook and tab means of the carrier plate and control panel are engaged, the carrier plate is effectively secured to the control panel to prevent movement in all but the linear sliding direction. Movement in that one direction is thereafter prevented by placing a screw or other locking means through the carrier plate and into the control panel or by the snapping into place of an integral flexible catch at the end of the sliding movement so that movement in all directions by the carrier plate with respect to the control panel is prohibited. This facilitates the simple, quick and easy mounting and assembly of the two members during manufacture and provides for speedy replacement when a carrier plate must be replaced due to circuitry malfunction.

Further, the carrier plate is comprised of a mounting plate, circuit boards, and circuit board coupling rails, so that a plurality of circuit boards can be joined together in one circuit board assembly by the rails and thereafter attached to the mounting plate creating one assembly which can easily and expeditiously be mounted on the control panel.

DETAILED DESCRIPTION OF THE PREFERRED EMBODIMENT

Figure 1:
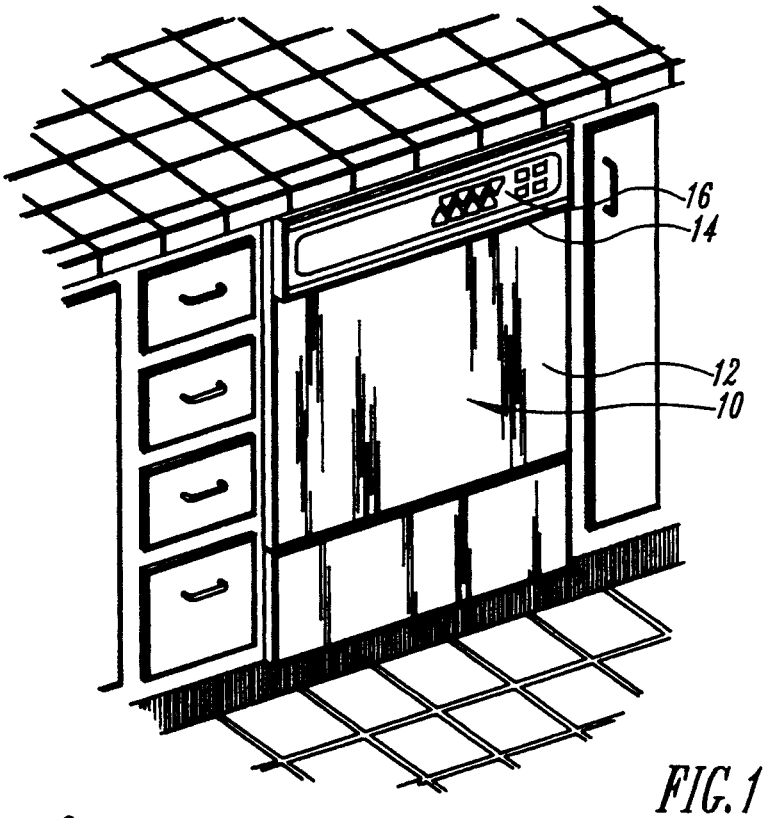
FIG. 1 is a perspective view of an assembled dishwasher.

Referring to the drawings, numeral 10 generally refers to a dishwasher as shown in FIG. 1. The dishwasher 10 includes an access door 12 which has an upper portion 14. This upper portion 14 includes a cycle selection panel 16 having several buttons or keys for selecting multiple washing operations. These means for function selection allow a user to input options such as cycle information or drying information and contain a button for turning the dishwasher 10 on or off. The door 12 of the dishwasher 10 is hinged to allow a user to open the door 12 and gain access to the interior washing compartment (not shown) of the dishwasher 10.

The cycle selection panel 16 is comprised of a control panel 18 and a carrier plate 20. The control panel 18 has an opening 22 therein. The periphery of the opening 22 in the control panel 18 includes a plurality of alternately occurring tab members 24 and hook members 26. Reciprocal tab members 28 and reciprocal hook members 30 are located around the periphery of the carrier plate 20.

Figure 2:
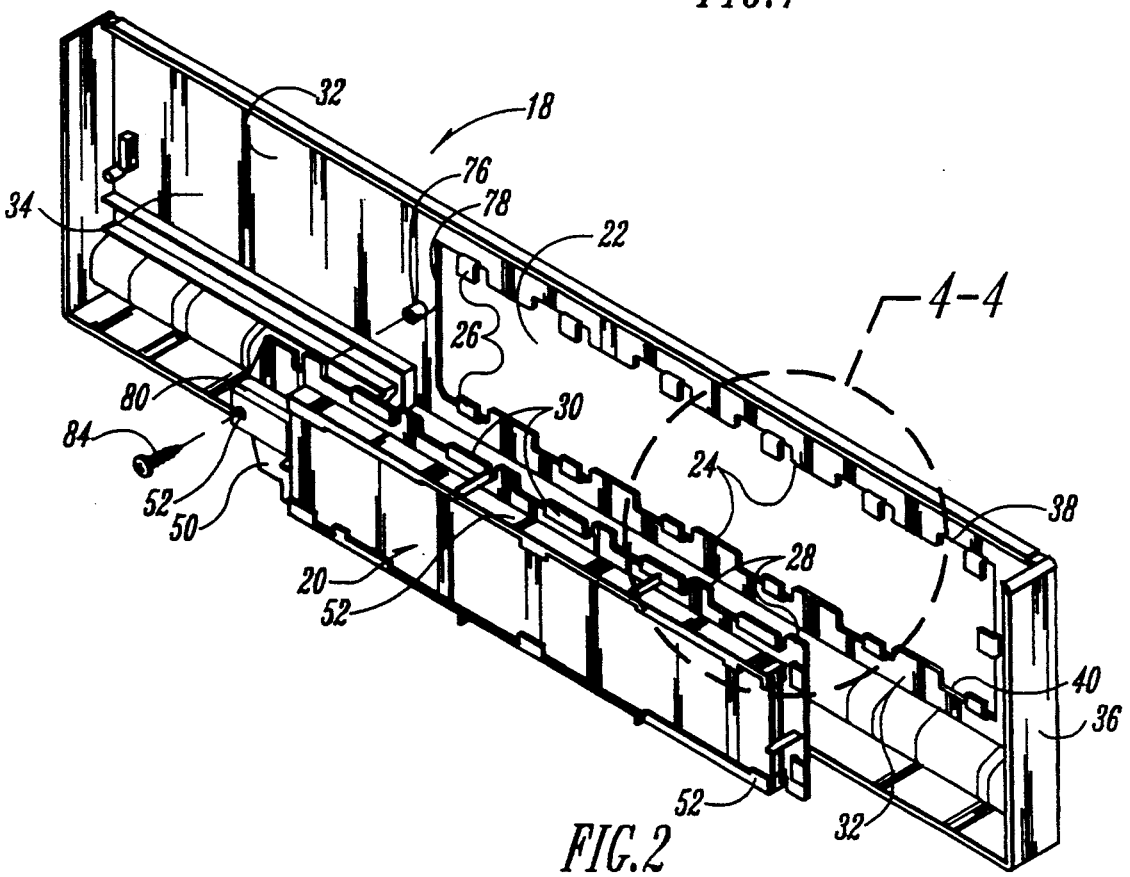
FIG. 2 is an enlarged detailed perspective view of the control panel and carrier plate shown in a disassembled state.
Figure 3:
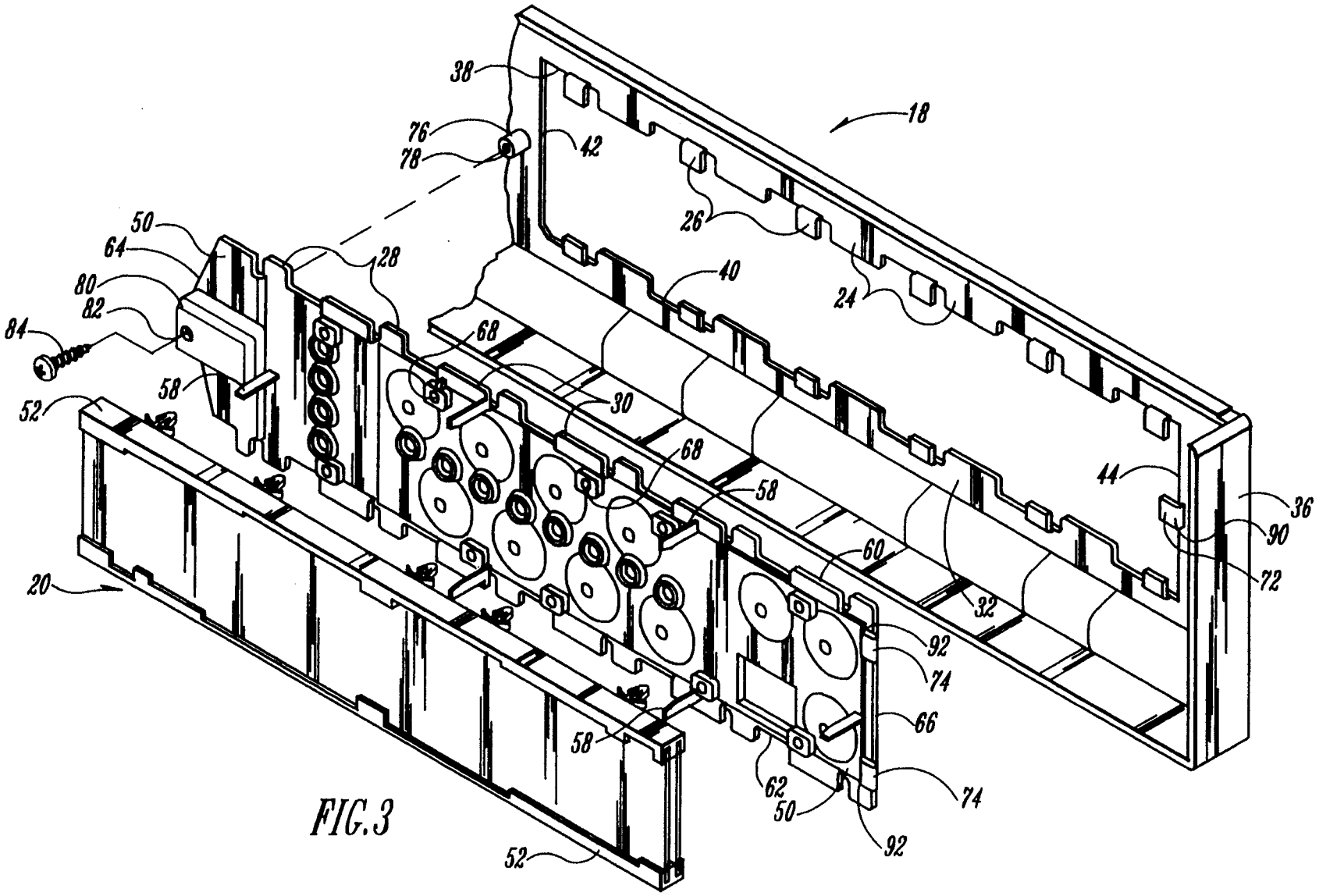
FIG. 3 is an exploded perspective view of the disassembled carrier plate, circuit board and control panel in perspective.
Figure 7:
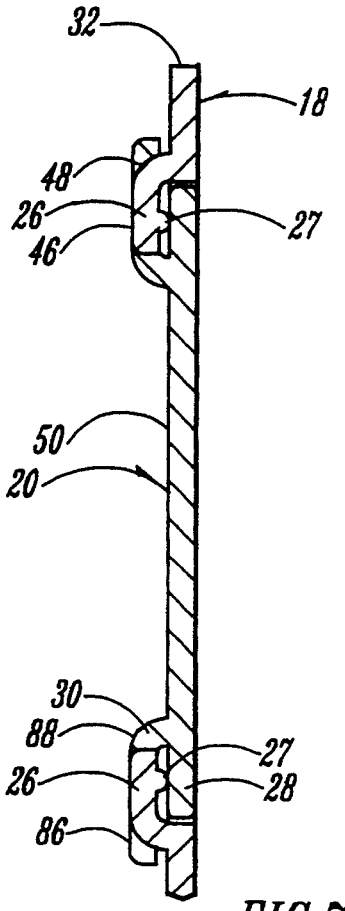
FIG. 7 is a sectional view taken along line 7—7 of FIG. 6.

The control panel 18 is shown in detail in FIGS. 2 and 3. The control panel 18 is comprised of a planar member 32 which has an exterior side (not shown) and an interior side 34. A side wall 36 extends perpendicularly from the interior side 34 of the planar member 32. The side wall 36 extends at least partially around the perimeter of the planar member 32. The opening 22 located in the control panel 18 is within the planar member 32. The opening 22 generally corresponds in configuration to the carrier plate 20. The opening 22 has an upper side 38, a lower side 40, a proximal side 42, and a distal side 44. Tab members 24 extend from the upper and lower sides 38, 40 of the opening 22 and are generally co-planar with the planar member 32 of the control panel 18. Hook members 26 are generally J-shaped. Each hook member 26 includes a substantially straight portion 46 which is spaced apart and substantially parallel to the planar member 32 of the control panel 18 as best seen in FIG. 7. The curved portion 48 of the hook members 26 connects the straight portion 46 to the planar member 32.

Figure 11:
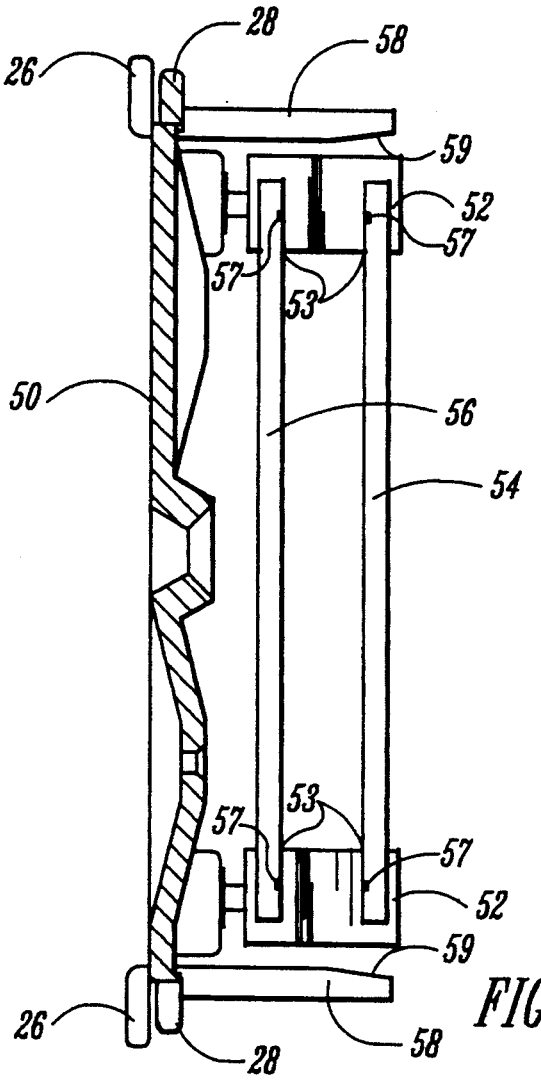
FIG. 11 is an enlarged sectional view taken along line 11—11 of FIG. 9.

The carrier plate 20, as shown in FIG. 3, is comprised of a face plate 50, rails 52, and one or more circuit boards (two shown), a top circuit board 54 and a bottom circuit board 56. As shown in FIG. 11, the top and bottom circuit boards 54, 56 are held in a generally parallel orientation by rails 52. The circuit boards 54, 56 include the electronic circuitry for controlling the operations of the dishwasher 10. Each rail includes a pair of slots 53 for receiving the respective edges of the circuit boards 54, 56. As best shown in FIG. 11, a ramped stud 57 is provided on one surface of each slot 53 for receiving a corresponding hole in the circuit boards, thereby securing the circuit boards in position between the rails.

Support posts 58 extend perpendicularly from the face plate 50 and are adapted to provide lateral support and increased rigidity to the structure of the rails 52 and the circuit boards 54, 56, as best seen in FIG. 11. The posts 58 include an inner tapered surface 59 for guiding the rails 52 into position on the face plate 50. By adding the structure including the rails 52 and circuit boards 54, 56 to the face plate 50, the overall rigidity of the carrier plate 20 is also increased.

The face plate 50 has an upper edge 60, a lower edge 62, a proximal edge 64, and a distal edge 66. The reciprocal tab members 28 extend from the upper and lower edges 60, 62 and are generally co-planar with the face plate 50. Referring to FIG. 7, reciprocal hook members 30 are generally J-shaped. Each reciprocal hook member 30 includes a substantially straight portion 86 which is spaced apart and substantially parallel to the face plate 50 as seen in FIG. 7. The curved portion 88 of the reciprocal hook members 30 connects the straight portion 86 to the face plate 50.

Figure 10:
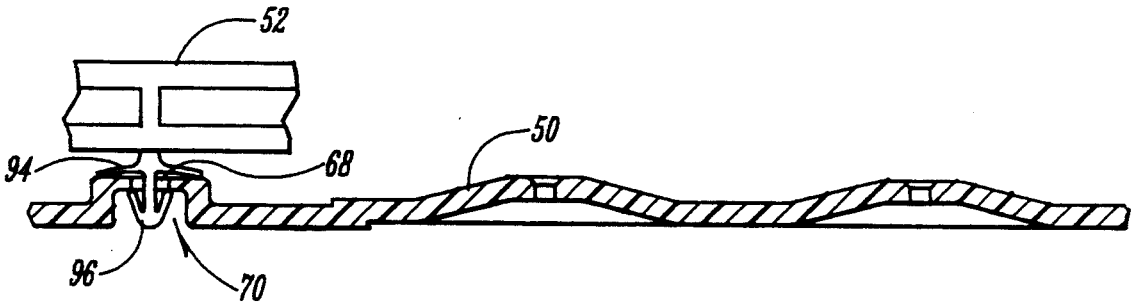
FIG. 10 is a sectional view taken along line 10—10 of FIG. 9.

As seen in FIGS. 3 and 10, the face plate 50 has apertures 68 therein for receiving the clipping means 70 which are located on the rails 52 adjacent the bottom circuit board 56. Apertures 68 are raised as shown in FIG. 10 and clipping means 70 include a support portion 94 which prevents further movement of the rails 52 toward the face plate 50 and a grapnel-shaped anchor portion 96 which is pushed through aperture 68 of the face plate 50 to prevent the rails 52 from pulling away from the face plate 50.

Figure 6:
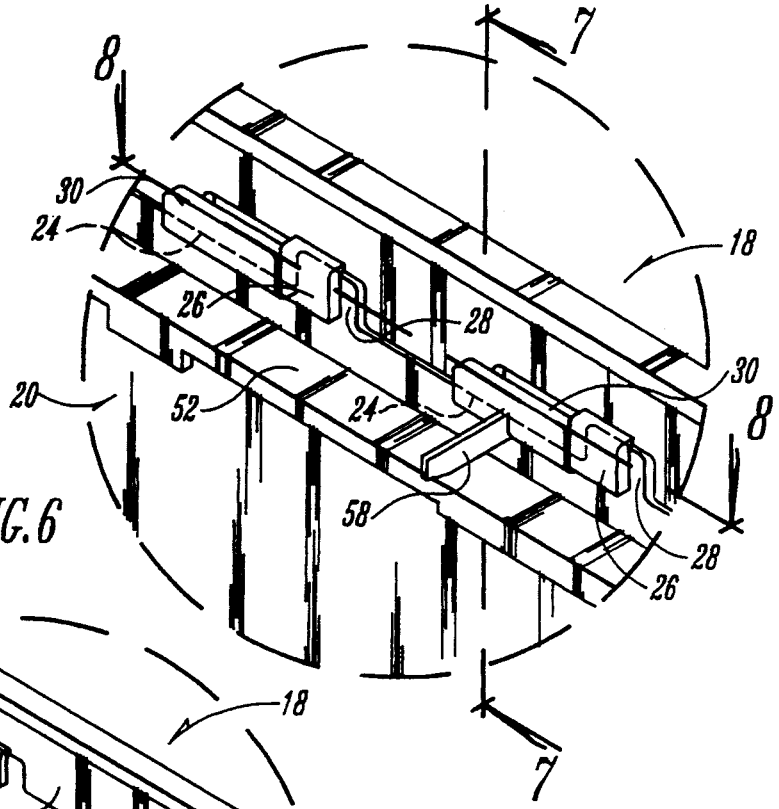
FIG. 6 is a view similar to FIG. 5 showing the carrier plate and control panel in a locked position.
Figure 4:
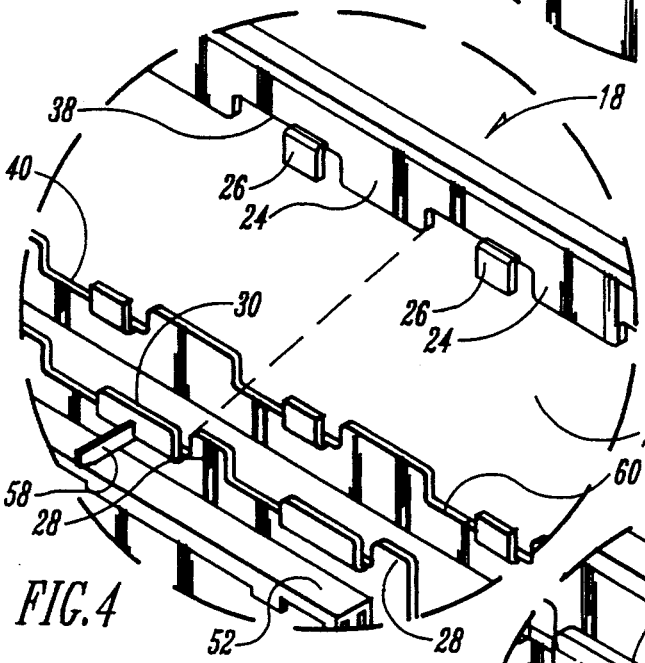
FIG. 4 is an isolated perspective view taken from lines 4—4 of FIG. 2.
Figure 5:
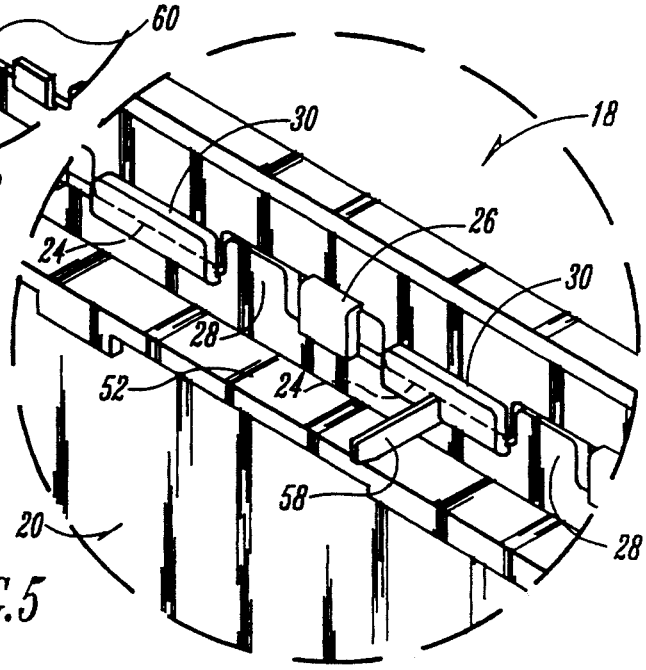
FIG. 5 is an isolated perspective view similar to FIG. 4 but with carrier plate and control panel in an unlocked engaging position.
Figure 8:
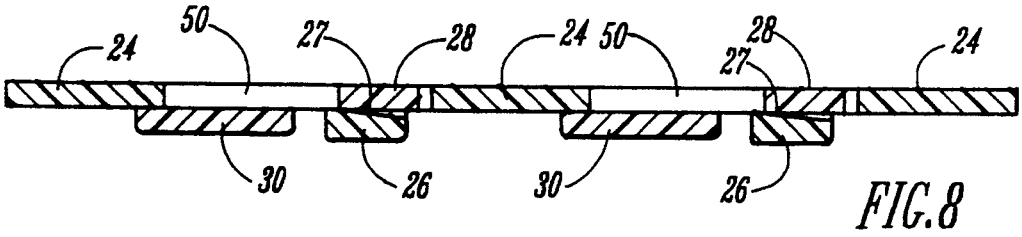
FIG. 8 is a sectional view taken along line 8—8 of FIG. 6.
Figure 9:
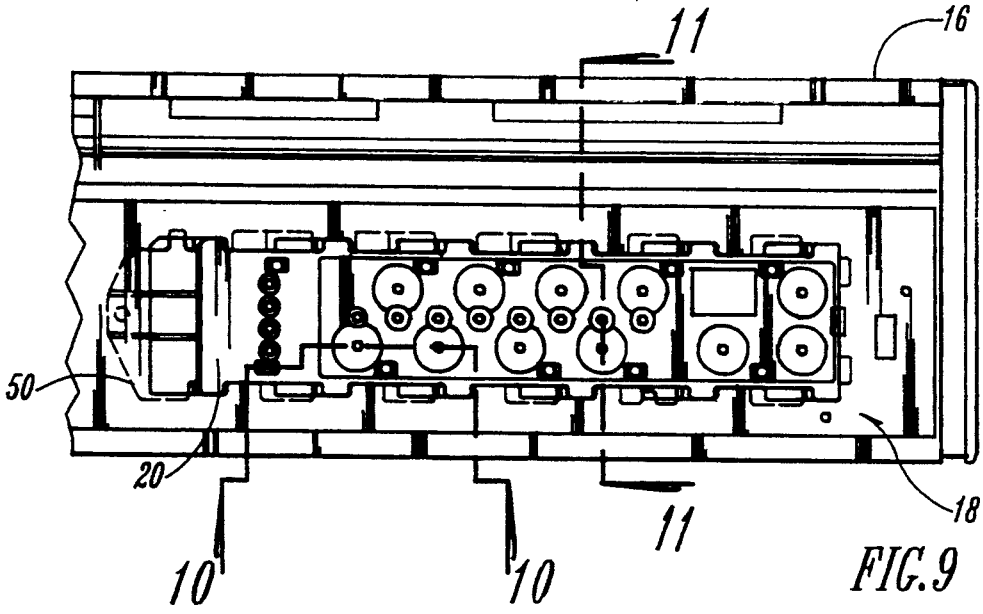
FIG. 9 is a plan view showing the carrier plate mounted in the control panel.

In order to secure the carrier plate 20 to the control panel 18, the carrier plate 20 is positioned on the interior side 34 of the control panel 18 so that the tab and hook members 24, 26 and the reciprocal tab and hook members 28, 30 are laterally spaced apart and not engaged. FIGS. 4 and 5 show the alignment of the carrier plate 20 with the control panel 18 so the tabs 24, 28 and hooks 26, 30. The carrier plate 20 is then slidably moved toward the distal side 44 of the opening 22 so that the hook members 26 engage the reciprocal tab members 28 and the tab members 24 engage the reciprocal hook members 30. This overlapping of hook and tab members is shown in FIGS. 6–8. As seen in FIG. 8, hooks 26 on the control panel include a small ramp 27 facilitating a flush and solid retention of the carrier plate 20 due to the interference fit between the hooks 26 and the reciprocal tabs 28 on the carrier plate 20. The straight portions 46, 86 of the respective hook members 26, 30 are substantially flush with the tab members 24, 28 when engaged thereby preventing motion of the carrier plate 20 with respect to the control panel 18. Thus, the planar member 32 of the control panel 18 is substantially planar with the face plate 50 of the carrier plate 20, as seen in FIG. 7.

A J-shaped distal hook 72 is located on the distal side 44 of the opening 22 so that when the carrier plate 20 is moved toward the distal side 44, the face plate 50 engages the curved portion 90 of the distal hook 72 and prevents further movement toward the distal side 44. Further, J-shaped reciprocal distal hooks 74 located on the face plate 50 at the distal edge 66 also prevent further movement toward the distal edge 66 after the curved portions 92 of the reciprocal distal hooks 74 have engaged the distal side 44 of the opening 22.

A protrusion 76 extends from the interior side 34 of the planar member 32 and contains bore 78. A channel 80 located in the face plate 50 allows the protrusion 76 to avoid contact with the carrier plate 20 as the carrier plate is slid toward the distal size 44 of the opening 22. The channel 80 has a generally inverted U-shaped cross-section. When the carrier plate 20 is moved to the locked position, in other words when the carrier plate 20 is moved toward the distal side 44 of the opening 22 as far as the distal hook 72 and reciprocal distal hooks 74 provide, the bore 78 will be aligned with an aperture 82 in the channel 80 so that a fastener 84, which may be a thread forming screw or its equivalent may be used to secure the carrier plate 20 in the locked position. By engaging the fastener 84 and the bore 78 through the aperture 82 in the channel 80, the carrier plate 20 is substantially locked in position and substantially prevented from movement in any direction.

Locking can be alternately accomplished by a flexible catch member (not shown) or face plate 50 or channel 80 engaging behind a protrusion on the interior side 34 of planar member 32 or behind protrusion 76.

In the preferred embodiment, the control panel 18 and carrier plate 20 are molded from a plastic material which is preferably polyvinyl chloride. However, the materials of the invention can be varied without detracting therefrom.

In the drawings and specification there has been set forth a preferred embodiment of the invention, and although specific terms are employed, these are used in a generic and descriptive sense only and not for the purpose of limitation. Changes in the form and the proportion of parts as well as in the substitution of equivalence are contemplated as circumstances may suggest or render expedient without departing from the spirit or scope of the invention as further defined in the following claims.

What is claimed is:

1. A control board mounting system, comprising:

a control panel having a planar surface containing an opening therein, the opening having a periphery associated therewith and coupling means located on the periphery of the opening;

a carrier plate having a periphery associated therewith and reciprocal coupling means located on the periphery of the carrier plate, the carrier plate capable of slidable movement relative to the opening of the control panel between a first position wherein the coupling means and the reciprocal coupling means are disengaged and a second position wherein the coupling means and the reciprocal coupling means are engaged.

2. The control board mounting system of claim 1 wherein the coupling means comprises a row of alternately occurring tab and hook means and wherein the reciprocal coupling means comprises a row of oppositely aligned tab and hook means.

3. The control board mounting system of claim 2 wherein the control panel further comprises an end hook means for limiting linear movement of the carrier plate relative to the opening and for limiting the carrier plate from perpendicular movement relative to the control panel.

4. The control board mounting system of claim 1 wherein said carrier plate further comprises:

spaced apart rails between which is mounted at least one circuit board held in a substantially parallel orientation relative to the carrier plate by the rails, the rails having attachment means extending therefrom for securing the rails to the carrier plate.

5. The control board mounting system of claim 4 wherein the securement of the rails and circuit board to the carrier plate forms a substantially rigid structure, thereby providing torsional rigidity to the control panel when the carrier plate is mounted thereon.

6. The control board mounting system of claim 4 wherein each of the rails include one or more slots for receiving the circuit board.

7. The control board mounting system of claim 6 wherein the rails include retention members for securing the circuit board in position between the rails.

8. The control board mounting system of claim 2 wherein the hook means are generally J-shaped.

9. The control board mounting system of claim 1 further comprising lock means for maintaining the carrier plate in the second position.

10. The control board mounting system of claim 9 wherein the lock means is a screw extending through the carrier plate and threadably received in the control panel.

11. A control board mounting system, comprising:

a control panel including an extended planar surface with an opening therein, at least two opposed sides of the opening having a plurality of alternately occurring hook members and tab members spaced along the length thereof;

a carrier plate corresponding in configuration to the control panel opening for mounting at least one circuit board, the carrier plate including a plurality of alternately occurring tab members and hook members spaced along at least two opposite edges of the carrier plate and cooperable with the hook and tab members of the control panel in a substantially coplanar posture; and lock means operable for locking the carrier plate to the control panel upon engagement of the cooperable hook and tab members.

12. The control board mounting system of claim 11 wherein the carrier plate further comprises:

one or more circuit boards held in a substantially parallel orientation relative to the carrier plate by rails, the rails containing attachment means; and the carrier plate adapted to receive the attachment means from the rails.

13. The control board mounting system of claim 12 wherein the rails and circuit board form a substantially rigid structure with the carrier plate, thereby providing torsional rigidity to the control panel when the carrier plate is mounted thereon.

14. The control board mounting system of claim 12 wherein the control panel further comprises an end hook means for limiting linear movement of the carrier plate relative to the opening and for limiting the carrier plate from perpendicular movement relative to the control panel.

15. The control board mounting system of claim 11 wherein the end hook means are generally J-shaped.

16. A method of mounting a carrier plate in an opening of a control panel comprising the steps of:

locating the carrier plate in the opening of the control panel in such a manner that coupling means of the control panel and reciprocal coupling means associated with the carrier plate are disengaged;

moving the carrier plate into an engaging position wherein the coupling means and the reciprocal coupling means are engaged;

locking the carrier plate in the engaging position.

17. The method of claim 16 wherein the carrier plate is slidably moved in a lateral direction with respect to the control panel between the engaged and disengaged positions.

18. The method of claim 16 wherein the coupling means and reciprocal coupling means overlappingly engage one another.

19. A method of assembling a carrier plate with a control board to the control panel of an appliance, the control panel including a substantially planar portion having an opening therein with opposite sides and with a plurality of spaced apart tabs and hooks extending from the opposite sides of the opening, the carrier plate having opposite sides with a plurality of hooks and tabs extending from the opposite sides, the method comprising:

positioning the carrier plate within the opening of the control panel planar portion such that the hooks and tabs of the carrier plate are located adjacent to respective tabs and hooks on the control panel;

sliding the carrier plate laterally with respect to the control panel such that the hooks and tabs of the carrier plate overlappingly engage the tabs and hooks, respectively, of the control panel.

20. The method of claim 19 further comprising locking the carrier plate and control panel together to prevent further movement of the carrier plate relative to the control panel.

21. The control board mounting system of claim 1 wherein the carrier plate has a planar surface which is coplanar with the planar surface of the control panel.

22. The control board mounting system of claim 2 wherein the hook means on the coupling means includes a ramp for providing increased friction between the hook means and a corresponding tab means on the reciprocal coupling means.

23. The control board mounting system of claim 11 wherein at least a portion of the hook members or tab members on the control panel includes a ramp to provide frictional engagement with a corresponding tab member or hook member on the carrier plate.

24. The method of claim 16 wherein the control panel and the carrier plate are coplanar when the carrier plate is located in the opening of the control panel.

25. The method of claim 16 further comprising providing increasing frictional forces between the control panel and carrier plate when the carrier plate is moved from the disengaged to the engaging position.

26. The method of claim 19 wherein the control panel and the carrier plate are coplanar when the carrier plate is located in the opening of the control panel.

27. The method of claim 19 further comprising providing increasing frictional engagement between the overlapping hooks and tabs as the carrier plate is slid laterally with respect to the control panel.

* * * * *